US006900780B1

(12) United States Patent
Amano

(10) Patent No.: US 6,900,780 B1
(45) Date of Patent: May 31, 2005

(54) PLASMA DISPLAY DISCHARGE TUBE AND METHOD FOR DRIVING THE SAME

(75) Inventor: Yoshifumi Amano, Kamakura (JP)

(73) Assignee: Technology Trade and Transfer Corporation, Kamakura (JP)

( * ) Notice: Subject to any disclaimer, the term of this patent is extended or adjusted under 35 U.S.C. 154(b) by 0 days.

(21) Appl. No.: 09/068,689

(22) PCT Filed: Sep. 18, 1997

(86) PCT No.: PCT/JP97/03299

§ 371 (c)(1),
(2), (4) Date: Aug. 13, 1998

(87) PCT Pub. No.: WO98/12728

PCT Pub. Date: Mar. 26, 1998

(30) Foreign Application Priority Data

Sep. 18, 1996 (JP) ..... P8-282835
Sep. 20, 1996 (JP) ..... P8-285829

(51) Int. Cl.[7] ..... G09G 3/28
(52) U.S. Cl. ..... 345/60; 345/67; 345/68
(58) Field of Search ..... 345/60, 61, 62, 345/63, 66, 67, 68, 71; 315/169.1, 169.4

(56) References Cited

U.S. PATENT DOCUMENTS 3,938,135 A * 2/1976 DeJule et al. ..... 345/68
5,744,909 A * 4/1998 Amano ..... 345/60
5,990,854 A * 11/1999 Weber ..... 345/66

FOREIGN PATENT DOCUMENTS

| | | |
|---|---|---|
| DE | 43 02 412 A1 | 1/1994 |
| DE | 43 08 216 A1 | 1/1994 |
| JP | 6-60814 | 3/1994 |
| JP | 6-89667 | 3/1994 |
| JP | 8-137431 | 5/1996 |
| JP | 8-194449 | 7/1996 |
| JP | 8-328506 | 12/1996 |
| JP | 95-5566 | 6/1997 |
| JP | 95-5567 | 6/1997 |
| JP | 9-138667 | 7/1997 |
| JP | 230258 | 8/2000 |

* cited by examiner

*Primary Examiner*—Xiao Wu
(74) *Attorney, Agent, or Firm*—Jaspan Schlesinger Hoffman LLP

(57) ABSTRACT

According to the present invention, in a plasma display discharge tube in which a plurality of stripe-like anode electrodes (11) and a plurality of stripe-like cathode electrodes (9) are arranged at a predetermined interval to be crossed each other, to thereby constitute an X-Y matrix electrode with a space at each of the crossing portions thereof as a pixel and a plurality of pixels are selectively excited according to an image to display an image, there is provided a plasma display discharge tube in which there are provided an AC type memory electrode (1) arranged opposite to the X-Y matrix electrode (9) and (11) common to all the pixels, and an AC type auxiliary electrode (5) in contact with the AC type memory electrode (1) through an insulating layer and supplying an electric power through a coupling capacitor formed between the same and the AC type memory electrode (1), wherein a memory discharge display is performed between the X-Y matrix electrode (9) and (11) and the AC type memory electrode (1). According to the present invention with the above arrangement, the electrode structure can be simplified to reduce manufacturing steps in number, driving using a pulse memory scheme which can be conventionally realized by only a DC type plasma display discharge tube having high emission efficiency and excellent responsibility is made possible, and a plasma display discharge tube having a long-life AC type electrode can be obtained.

3 Claims, 11 Drawing Sheets

Pad
Pss

Em
+50V
0V

Ea
+100V
0V

Ek1
+150V
0V
-100V

Ek2
+150V
0V
-100V

Ekn
+150V
0V
-100V

Ewa
+50V
0V
-30V
+20V
+90V

Ewna
+50V
0V

Pad
Pss

Em
+50V
0V

Ea
+100V
0V

Ek
+150V
0V
-100V

Ek
+150V
0V
-100V

Ek
+150V
0V
-100V

Ewa
+50V
0V
+20V
-30V

Ewna
+50V
0V

Pad
Pss

Em
+50V
0V

Ea
+100V
0V

Ek1
+150V
0V
-100V

Ek2
+150V
0V
-100V

Ekn
+150V
0V
-100V

Ewa
+50V
0V
-30V
+20V

Ewna
+50V
0V

Pads
Pad
Pss

Ea
+100V
0V
-100V

Ek1
+100V
0V
-100V
-150V

Ek2
+100V
0V
-100V
-150V

Ekn
+100V
0V
-100V
-150V

Ewa
+100V
0V
-100V
-150V

PLASMA DISPLAY DISCHARGE TUBE AND METHOD FOR DRIVING THE SAME

TECHNICAL FIELD

The present invention relates to a plasma display discharge tube and a method of driving the same.

BACKGROUND ART

The structure of a conventional plasma display discharge tube (PDP) is roughly classified into a DC type PDP having a structure in which the metal surfaces of a plurality of electrode groups constituting an X-Y matrix are exposed to a discharge space and an AC type PDP having a structure in which the surfaces of X-Y matrix electrode group are covered with an insulating layer. There is also a hybrid PDP which is constituted by using the feature of each of the DC type PDP and the AC type PDP.

As a drive method of driving these PDPs by a memory operation, in the DC type PDP, there is a pulse memory scheme using a phenomenon in which a discharge cell which discharges once tends to easily discharge again because of the presence of metastable atoms and charged particles existing in a space.

As the AC type PDP, there is a wall-charge memory scheme which makes a re-discharge by using the difference between wall voltages generated by so-called wall charges, i.e., charged particles accumulated on insulating layers on the surfaces of X-Y electrodes.

In addition, although a conventional hybrid PDP (see Japanese Examined Patent Publication No. 7-70289) according to the invention of the present inventor uses a wall-charge memory scheme as shown in FIG. 1, the following method is employed. That is, after the changes generated by an address discharge due to the DC type X-Y matrix electrode are accumulated on a pair of memory sheet electrodes shared by all pixels as wall charges, a discharge is continued between both the memory sheet electrodes.

The memory sheet type PDP shown in FIG. 1 will be briefly described below. Referring to FIG. 1, a front glass plate is omitted. Anode electrodes 31 serving as a plurality of address electrodes and cathode electrodes 32 serving as a plurality of address electrodes which are arranged with a predetermined interval to cross one another are both DC type electrodes in which electrodes themselves are exposed to a gaseous space. The plurality of cathode electrodes 32 are adhesively formed on a back glass plate BGP by a method such as printing or the like. The plurality of anode electrodes 31 are transparent electrodes which are adhesively formed on a front glass plate.

Memory sheets 33 and 34 serving as AC type electrodes which are covered with an insulating layer are located between the plurality of anode electrodes 31 and the plurality of cathode electrodes 32 to be opposed to each other. The memory sheets 33 and 34 are formed such that metal plates are etched to have grating-like shapes, and all the surfaces thereof including the inner walls of the through holes are covered with an insulating layers.

The plurality of anode electrodes 31 and the plurality of cathode electrodes 32 are arranged such that the crossing portions of these electrodes correspond to the through holes of the memory sheets 33 and 34, respectively.

Space charges generated by discharges of pixels arranged at the crossing portions between the plurality of address electrodes 31 and 32 crossing each other are accumulated on the wall surfaces in the through holes of the memory sheets 33 and 34 as wall charges. An AC pulse voltage is applied between both the memory sheets 33 and 34 by the using the wall changes, thereby performing a continuous memory discharge display.

Another hybrid PDP (see Japanese Examined Patent Publication No. 3-50378) according to the invention of the present inventor, as shown in FIG. 2, has a DC type X-Y matrix and an AC electrode called a single trigger electrode which is common to both the whole surfaces. The trigger electrode has only a so-called trigger operation for assisting the discharge of the DC type PDP to rise, but has no memory function. As the trigger electrode, for example, a metal mesh-like electrode having the same structure as that of the memory sheet described above can also be used. However, this electrode has a structure which can perform a trigger operation but is not sufficient to perform a memory operation. In addition, a proper memory drive method has not been invented.

The PDP using the trigger scheme shown in FIG. 2 will be briefly described below. A plurality of anode electrodes 41 and a plurality of cathode electrodes 42 which are opposed to each other at a predetermined interval are both DC type electrodes. Although this PDP is a DC type PDP using a linearly sequential drive scheme, a trigger electrode 45 serving as an AC type electrode all the surface of which is covered with an insulating layer is provided to decrease a discharge voltage and improve a response speed.

The trigger electrode 45 in which all the surface is flat is adhesively formed on a back glass plate BGP by thick-film printing or the like, and an insulating layer 44 is adhesively formed on the surface of the trigger electrode by thick-film printing or the like to cover the trigger electrode. The plurality of cathode electrodes 42 are adhesively formed on the insulating layer 44 by thick-film printing or the like.

Although the plurality of anode electrodes 41 are adhesively formed on a front glass plate FGP, the anode electrodes are transparent thin-film electrodes.

A plurality of barrier ribs 43 are adhesively formed on the front glass plate FGP by laminate printing of a low-melting-point glass or the like such that the barrier ribs are parallel to the anode electrodes 41.

This employs a linearly sequential drive scheme, and does not perform a memory operation. Prior to a discharge of the cathode electrodes 42, the trigger electrode 45 is set in a negative potential. Thereafter, a discharge is made between the anode electrodes 41 and the cathode electrodes 42 to accumulate positive wall charges on the insulating layer 44. When the cathode electrodes 42 are sequentially replaced and then discharged, the positive wall charges make weak discharges. This discharge serves as a trigger to make a discharge between the anode electrodes 41 and the cathode electrodes 42 as a main discharge.

In the above prior art, many studies and results about a pulse memory scheme in the DC type PDP are reported. However, the pulse memory scheme has not been realized for the following reason. That is, sputtering of the cathodes caused by impact of positive charges, i.e., ions. This is a problem shared by the DC type PDPS.

Although the conventional memory sheet type hybrid PDP shown in FIG. 1 has been invented to solve the problems of a conventional DC type PDP or an AC type PDP, there are several problems which are not solved.

For example, since there are required two electrode plates, a reduction in cost cannot be easily achieved. A large electrostatic capacity between the two memory electrodes is a disadvantage in view of driving the same.

As one form of the trigger electrode DC type PDP shown in FIG. 2, there is proposed a PDP having a metal mesh structure in which one memory sheet of the above memory sheet type PDP is used as a trigger electrode. However, since a phosphor-coated portion is limited, the luminance is low, and only a trigger operation for helping rising of a DC discharge is found out. A memory drive method using the above structure has not been invented.

As the plasma display discharge tube, in addition to the above DC type PDP, AC type PDP, and hybrid PDP, there is known a half-ADC type PDP in which one of X and Y electrodes is of an AC type and the other is of a DC type.

In order to make these PDPs color, a method of coating three primary colors, i.e., red, green, and blue phosphors on a portion near a discharge cell is used. In this case, in the DC type PDP, the phosphors are coated on the anode electrode side to avoid ion impact. However, in the AC type PDP, the X and Y electrodes receive the ion impact.

In a three-electrode AC type PDP proposed to avoid the ion impact, as shown in FIG. 3, a sustain discharge (memory discharge) is performed on the same plane, and a phosphor-coated surface is assured on the side opposing the plane, thereby reducing the problem of ion impact. This is a hybrid type PDP obtained by complexing an AC type electrode and a DC type electrode, and various PDPs of the similar type as described above are also proposed.

The three-electrode AC type PDP shown in FIG. 3 will be briefly described below. A plurality of X electrodes 53 for address are adhesively formed on a back glass plate BGP by thick-film printing or the like. In addition, a plurality of partition wall (barrier ribs) 56 are adhesively formed on the back glass plate BGP by laminate printing of a low-melting-point glass or the like to be parallel to the plurality of X electrodes 53. Red, green, and blue phosphors 57 are coated on the side surfaces of each of the X electrodes 53 and each of the barriers 56 in correspondence with the X electrodes 53. Even though the X electrodes 53 are coated with the phosphor, since the particles thereof are coarse, the electrodes operate as the DC type electrodes but not as the AC type electrodes.

A plurality of stripe-like Y electrodes 51 and a plurality of stripe-like Yc electrodes 52 which are parallel to each other are formed on a front glass plate FGP, and each of the surfaces of the electrodes are covered with an insulating layer and a protective layer formed thereon. There electrodes each operate as the AC type electrode.

The plurality of X electrodes 53 and the plurality of Y electrodes 51 cross one another to constitute an X-Y matrix electrode, and functions as an address electrode. All the Yc electrodes 52 are commonly connected to each other to carry out a memory discharge between the Yc electrodes 52 and the same.

A positive pulse voltage depending on a video signal is applied to the plurality of X electrodes 53, and a negative pulse voltage depending on a sequential scanning signal is applied to the plurality of Y electrodes 51. When a discharge occurs therebetween, a positive wall charge is accumulated on the Y electrodes 51. Thereafter, an AC pulse voltage is applied between the Y electrodes 51 and the Yc electrodes 52 to thereby perform a continuous memory discharge display.

Since the phosphor layers 57 are formed on the X electrodes 53 separated from the display discharge electrodes, such a characteristic feature that the phosphors 57 do not receive impact of ions generated by the discharge can be obtained.

As a method of driving these PDPs by a memory operation, in the DC type PDP, there is a pulse memory scheme PDP using such a phenomenon that because of the presence of metastable atoms and charged particles existing in a discharge cell space which is once discharged, a re-discharge tends to be easily produced. Further, in the AC type PDP, there is a wall-charge memory scheme which makes a re-discharge by using the difference between wall voltages generated by the so-called wall charges, i.e., charged particles accumulated on the insulating layers on the surfaces of the X and Y electrodes.

In the above conventional DC type PDP, the role of the anode electrode and the role of the cathode electrode are separated from each other. Since the anode side does not receive the ion impact, a phosphor can be coated on the anode side. However, since the anode side does not have a memory function inherently, only low luminance is obtained disadvantageously.

In the PDP using the DC type pulse memory scheme, sputtering of the cathode caused by impact of positive charges, i.e., ion impact disadvantageously made the life time of the panel short.

The AC type PDP has a characteristic feature in which a memory function can be obtained by using wall charges. However, since both the X and Y electrodes receive ion impact, a phosphor coating portion is extremely limited, and sufficient luminance and sufficient life time cannot be assured.

Since the half-AC type PDP described above has the same operation as that of the AC type PDP, the former has the same problem as that of the AC type PDP. In a three-electrode AC type PDP proposed to solve the problem, electrodes increase in number not only to prevent an increase in resolution but also to make improvements in luminance and a yield difficult.

In consideration of the above points, the present invention is to propose a plasma display discharge tube, having a long-life AC type electrode, in which an electrode structure is simplified to reduce manufacturing steps in number, and driving using a pulse memory scheme which can be conventionally realized by only a DC type plasma display discharge tube having high emission efficiency and excellent responsibility is made possible.

DISCLOSURE OF INVENTION

The first present invention is a plasma display discharge tube in which a plurality of stripe-like anode electrodes and a plurality of stripe-like cathode electrodes are arranged with a predetermined interval to be alternatively crossed to each other, a space at each of the crossing portions is used as a pixel to constitute an X-Y matrix electrode, and the plurality of pixels are selectively excited according to an image to display the image, in which there are provided an AC type memory electrode arranged opposite to the X-Y matrix electrode and common to all the pixels and an AC type auxiliary electrode in contact with the AC type memory electrode through an insulating layer and supplying an electric power by a coupling capacity formed between the AC type auxiliary electrode and the same, whereby a memory discharge display is performed between the X-Y matrix electrode and the AC type memory electrode.

According to the first present invention, the electrode structure can be simplified to reduce manufacturing steps in number, driving using a pulse memory scheme which can be conventionally realized by only a DC type plasma display discharge tube having a high light emission efficiency and an excellent responsibility is made possible, so that a plasma display discharge tube having a long-life AC type electrode can be obtained.

The second present invention is a method of driving a plasma display discharge tube, which causes a plasma display discharge tube having a DC type address electrode constituted by an X-Y matrix electrode and an AC type memory electrode arranged opposite to the DC type address electrode and common to all pixels to perform a memory discharge display, in which, in an address operation period by the DC type address electrode, after a distribution of wall charges having a positive polarity or a negative polarity depending on an image is formed on an insulating layer of the AC type memory electrode, an AC sustain pulse voltage which is alternately positive or negative with respect to the potential of the AC type memory electrode is applied to a Y electrode serving as a scanning electrode of the DC type electrode in a memory display period, thereby performing a continuous memory discharge display on the basis of the wall charges formed on the insulating layer of the AC type address electrode in the address operation period.

According to the second present invention, by using a hybrid type plasma display discharge tube having a simple AC type electrode common to all the pixels which can conventionally perform only a trigger operation serving as an auxiliary role for the DC discharge, a method of driving a plasma display discharge tube which can perform a memory operation by a simple method can be obtained.

The third present invention is a method of driving a plasma display discharge tube, which causes a plasma display discharge tube having a DC type address electrode constituted by an X-Y matrix electrode and an AC type memory electrode arranged opposite to the DC type address electrode and common to all pixels to perform a memory discharge display, in which after wall charges having a negative polarity depending on an image are formed on an insulating layer of the AC type memory electrode by an address operation performed by the DC type address electrode, in a memory operation period, a sustain pulse voltage of a small width which becomes positive with respect to the potential of the AC type memory electrode and does not form wall charges having a positive polarity generated by a sustain discharge on the AC type memory electrode is intermittently and continuously applied to one of X and Y electrodes constituting the DC type address electrode in a pulse period in which a priming effect which lowers a re-discharge voltage in a space in which a discharge have occurred once is not eliminated, and a continuous memory discharge display is performed between the DC type address electrode and the AC type memory electrode.

According to the third present invention, a method of driving a plasma display discharge tube in which a pulse memory scheme which is conventionally employed in an only a DC type plasma display discharge tube can also be applied to the electrode of an AC type plasma display discharge tube which can achieve long life as a discharge electrode can be obtained.

According to the third present invention, compared with the second present invention, since the polarity of the DC electrode side is always set to be positive, there is no ion impact reception, and the life time of the panel can be elongated.

The forth present invention is a method of driving a plasma display discharge tube, wherein, in the method of driving a plasma display discharge tube according to the third invention, a pulse voltage having a negative polarity, which does not make a discharge but can erase wall charges having a positive polarity and formed undesirably on the AC type memory electrode, is applied between adjacent pulses of a continuous sustain pulse voltage having a positive polarity and a small width, and is applied to one of X and Y electrodes constituting the DC type address electrode in a memory operation period.

According to the fourth present invention, compared with the third present invention which has a memory function without producing wall charges, a driving operation is more reliable.

The fifth present invention is a plasma display discharge tube, having an X-Y matrix electrode constituted by a plurality of stripe-like X electrodes and a plurality of stripe-like Y electrodes which cross through partition walls, for selectively exciting a plurality of pixels at crossing portions of the plurality of X electrodes and the plurality of Y electrodes according to an image to perform discharge light emission, in which parts of the plurality of X electrodes, among of the X-Y matrix electrode, extending in the longitudinal direction of a picture screen are exposed to a gaseous space to constitute a DC type electrode, a phosphor is coated on the partition walls and a portion near the partition walls, the entire surface of the plurality of Y electrodes, among the X-Y matrix electrode, which are opposite to the plurality of X electrodes through the partition walls and extend in the lateral direction of the picture screen is covered with an insulating layer to constitute an AC type electrode, and the AC type electrode is arranged on a display surface side with respect to the DC type electrode.

According to the fifth present invention, the electrode structure can be simplified to reduce manufacturing steps in number, driving using a pulse memory scheme which can be conventionally realized by only a DC type plasma display discharge tube having high light emission efficiency and excellent responsibility is made possible, so that a plasma display discharge tube having a long-life AC type electrode can be obtained.

The sixth present invention is a method of driving a plasma display discharge tube, having an X-Y matrix electrode constituted by a plurality of stripe-like X electrodes and a plurality of stripe-like Y electrodes which cross through partition walls, for selectively exciting a plurality of pixels at crossing portions of the plurality of X electrodes and the plurality of Y electrodes according to an image to perform discharge light emission, in which wall charges according to an image are selectively formed on an insulating layer of the AC electrode corresponding to the plurality of pixels at the crossing portions of the X-Y matrix electrode by a linearly sequential drive method in an address period, a pulse voltage having a negative polarity is applied to the AC type electrode in a sustain period next to the address period to excite a discharge in only a pixel having negative wall charges between the same and a bias potential in the sustain period of the DC type electrode, after the width of a sustain pulse is set to smaller than about 1 $\mu$sec to erase the negative wall charges, wall charges having a positive polarity are prevented from being generated by reversing, and a sustain pulse having a small width is continuously applied to perform a pulse memory discharge display using a priming in a discharge space of the pixel.

According to the sixth present invention, a pulse memory can be realized by even an AC type cathode electrode, MgO or the like serving as an electrode material which can actually achieve life longer than that of a DC cathode electrode can be used.

BRIEF DESCRIPTION OF DRAWINGS

FIGS. 11A to 11G are timing charts showing potentials at respective portions of the display discharge tube in an embodiment of a method of driving the plasma display discharge tube shown in FIGS. 9 and 10.

BEST MODE FOR CARRYING OUT THE INVENTION

Figure 4:
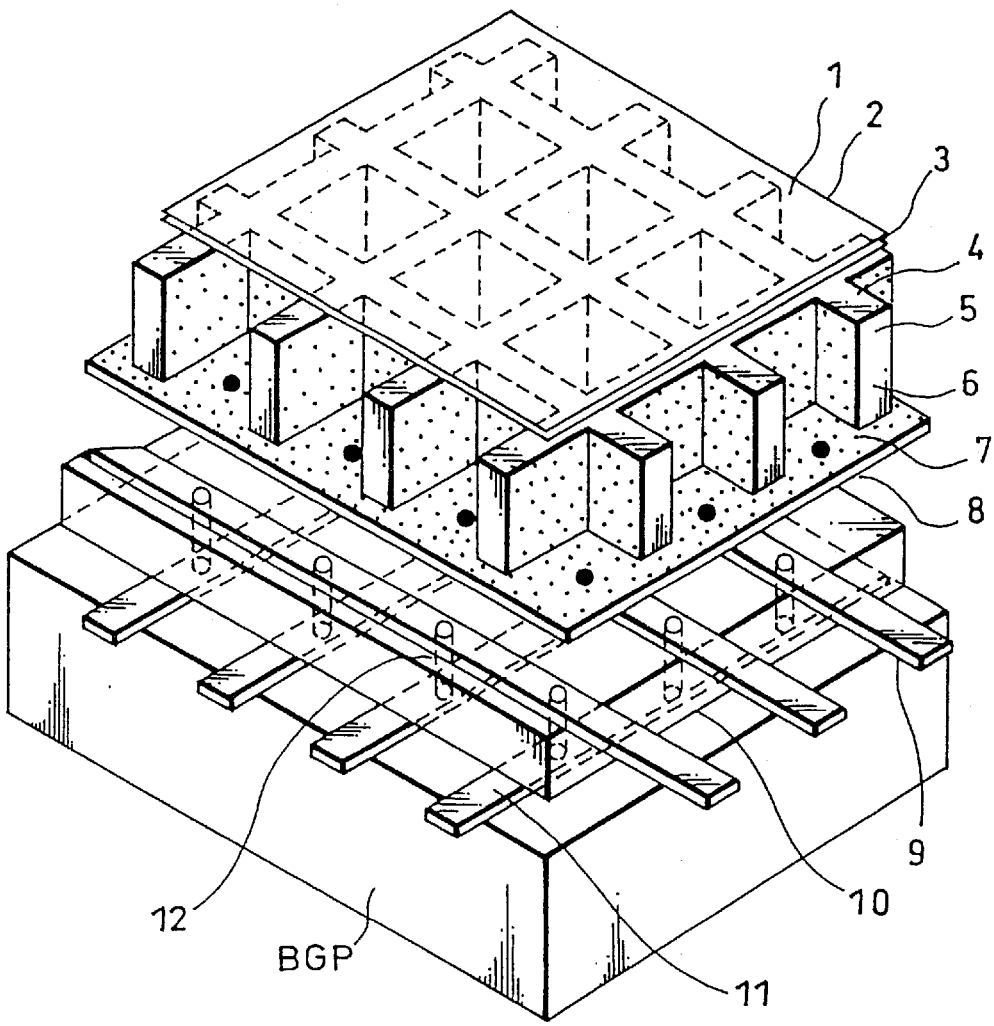
FIG. 4 is a developed perspective view showing a plasma display discharge tube according to an embodiment of the present invention.
Figure 5:
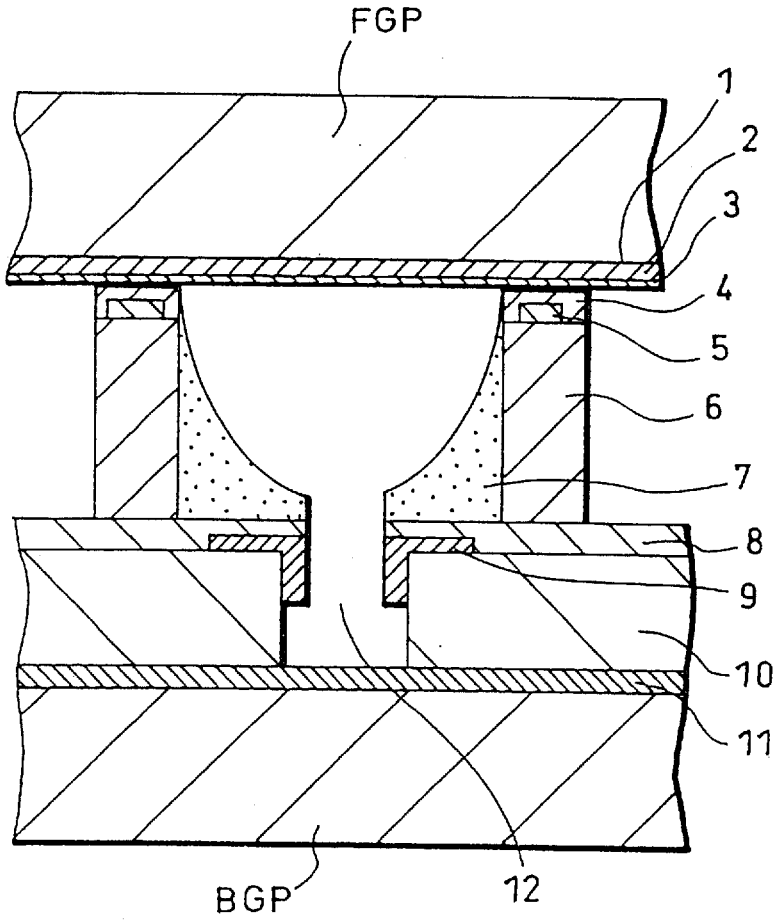
FIG. 5 is a sectional view showing the plasma display discharge tube shown in FIG. 4.

An embodiment of the present invention will be described below with reference to the developed perspective view in FIG. 4 and the sectional view in FIG. 5. Referring to FIGS. 4 and 5, reference symbol FGP denotes a front glass plate (omitted in FIG. 4), and reference symbol BGP denotes a back glass plate. Respective elements constituting a plasma display discharge tube are arranged between the front glass plate FGP and the back glass plate BGP.

On the front glass plate FGP, a transparent electrode layer (front electrode) 1 serving as a memory electrode, an insulating layer 2, and a protective layer 3 made of MgO or the like are sequentially laminated from the front glass plate FGP side.

On the back glass plate BGP, a plurality of anode electrodes 11 serving as stripe-like address electrodes having the same width are adhesively formed at a predetermined interval by a printing method or the like. On the back glass plate BGP, a partition wall layer 10 made of, e.g., glass is adhesively formed by, e.g., a printing method to cover the plurality of anode electrodes 11. On the partition wall layer 10, a plurality of stripe-like cathode electrodes 9 having the same width are adhesively formed at a predetermined interval by printing a conductive paste such as nickel or the like to cross the plurality of anode electrodes 11. In the partition wall layer 10, through-holes 12 constituting address discharge cells are formed at portion where the plurality of cathode electrodes 9 and the plurality of anode electrodes 11 cross. The plurality of cathode electrodes 9 and the plurality of anode electrodes 11 constitute an X-Y matrix electrode.

The cathode electrodes 9 and the anode electrodes 11 generate an address discharge at a portion between the opposite portions where the cathode electrodes and the anode electrodes are crossed each other to supply charged particles to the display side. For this reason, the positions of the cathode electrodes and the anode electrodes may be reversed, i.e., may be upside down.

On the partition wall layer 10, an insulating layer 8 is adhesively formed to cover the plurality of cathode electrodes 9. A grating-like barrier rib 6 having a predetermined thickness and made of an insulating material, for example, is adhesively formed on the insulating layer 8 to assure a space between the insulating layer and the front glass plate FGP. A conductive layer 5 serving as an AC type auxiliary electrode for supplying an electric power to the transparent electrode 1 through a coupling capacitor formed between the conductive layer and the transparent electrode 1 serving as the AC type memory electrode is adhesively formed on the top surface of the barrier rib 6, and an insulating layer 4 is adhesively formed on the top surface of the barrier rib 6 to cover the conductive layer 5.

A phosphor 7 is adhesively formed on the insulating layer 8 and the wall surface of the barrier rib 6. More specifically, red, green, and blue phosphors 7 are sequentially and circularly coated at every space surrounded by the barrier rib 6.

By the way, the shape of the barrier rib 6 is not limited to a grating, and the barrier rib may be constituted by parallel walls. In this case, the red, green, and blue phosphors 7 are sequentially and circularly coated at every long and narrow space surrounded by the barrier rib 6.

The entire barrier rib 6 may be made of a metal such as a 426 alloy, aluminum, titanium or the like, and the surface of the barrier rib is covered with an insulating layer. In this case, the barrier rib 6, the conductive layer 5, and the insulating layer 4 can be integrally formed.

An outside of a method for driving the plasma display discharge tube will be described below. The details of the drive method will be described later with reference to FIG. 6. In through holes selected, depending on an image to be displayed, from the through holes 12 at positions where the plurality of anode electrodes 11 and the cathode electrodes 9 which constitute an X-Y matrix electrode are crossed each other, an address discharge is induced. Charged particles generated on the basis of the address discharge are diffused toward the transparent electrode 1 on the front glass plate FGP side to which a voltage is applied, thereby forming wall charges on the protective layer 3. Next, when a sustain pulse voltage (memory pulse voltage) is applied to the plurality of cathode electrodes 9, a selective discharge according to a picture screen is generated by a voltage generated by the wall charges. The discharge is continuously kept by the sustain pulse voltage.

The periphery of each of the front glass plate FGP and the back glass plate BGP on which the respective elements constituting the plasma display discharge tube are arranged is sealed by a glass frit or the like, and discharge gases such as helium, xenon, neon, argon or the like are properly mixed to each other and sealed into the tube.

Since all the pixels may be turned on, the discharge cells driven by the sustain pulse voltage must cause a considerably large current to flow the transparent electrode 1 serving as a discharge electrode. However, when the transparent electrode 1 is made of a high-resistance material such as indium oxide or tin oxide, a sufficiently large current cannot flow to the transparent electrode 1.

Therefore, according to the present invention, the transparent electrode 1 and the conductive layer 5 are connected to an external terminal, and the transparent electrode and the conductive layer are brought into contact with each other through the insulating layers 2 and 4, thereby forming a capacitive coupling between the transparent electrode and the conductive layer. For this reason, a current to be supplied to each of the pixels can be sufficiently supplied from the conductive layer 5 serving as a good conductor through an electrostatic capacitor near the pixel.

Although a discharge current from the drive circuit to the pixel is supplied as described above, a position where a discharge is made on the pixel, i.e., electrode operating as a discharge electrode is the protective layer 3. This is because, when the protective layer 3 is made of MgO, the protective layer has a function of lowering a discharge voltage as a cathode material and a discharge voltage thereof is considerably lower than that on the surfaces of the conductive layer 5 and the phosphor 7. Therefore, although it is on the electrode, it need not be concerned that the phosphor 7 is degraded by receiving the ion impact.

According to the plasma display discharge tube described with reference to FIGS. 4 and 5, an electrode structure can be simplified to reduce manufacturing steps in number, driving using a pulse memory scheme which can be conventionally realized by only the DC type plasma display discharge tube having high light emission efficiency and excellent responsibility is made possible, so that a plasma display discharge tube having a long-life AC type electrode can be obtained.

According to the plasma display discharge tube described with reference to FIGS. 4 and 5, since the transparent electrode 1 serving as a memory electrode is a flat electrode, the steps for a plasma display discharge tube in which a transparent electrode film made of indium oxide or the like is patterned into stripes are not necessary.

Further, since the conductive layer 5 is formed on the barrier rib 6 on the back surface side or is the barrier rib 6 itself, junction of the peripheries of the front glass plate FGP and the back glass plate BGP can be considerably easily performed.

In addition, since the current required for the display discharge is supplied from the conductive layer 5, the step executed in an ordinary PDP, i.e., the step of stacking, as a bus electrode, an electrode in which chromium or copper is laminated on a transparent conductive film made of indium oxide is not required.

In addition, since the bus electrode or the like which shields light radiation is not formed on the front glass plate FGP side, high luminance can be obtained.

Since display discharge occurs on the protective layer 3 but not on the conductive layer 5, the phosphors 7 do not receive any ion impact.

Figure 1:
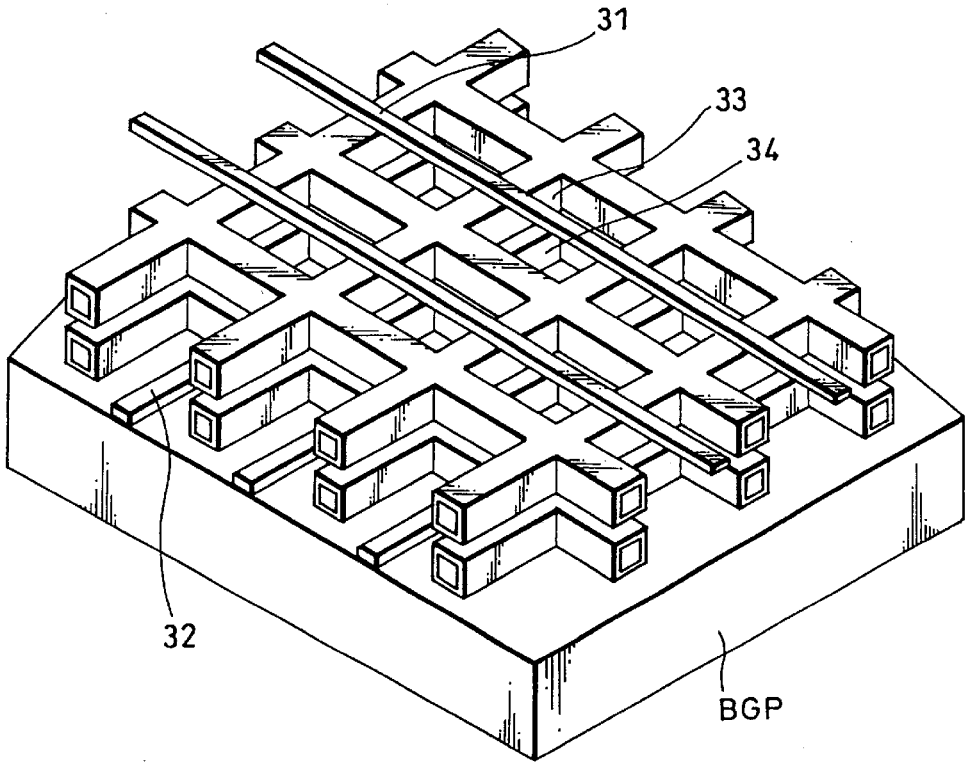
FIG. 1 PRIOR ART
FIG. 1 is a developed perspective view showing a conventional memory sheet type plasma display discharge tube.
Figure 2:
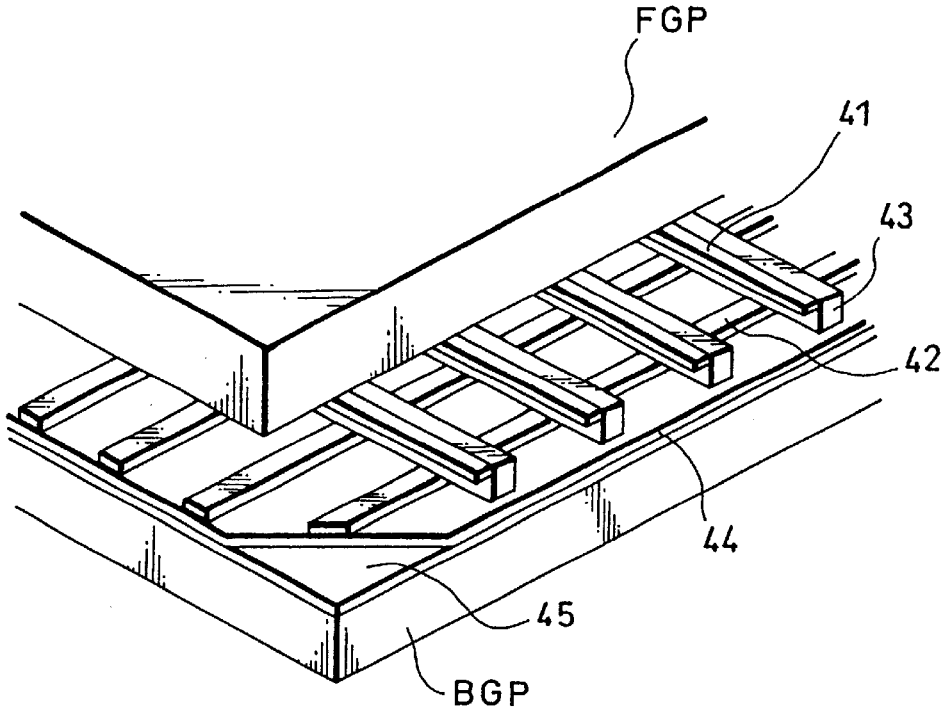
FIG. 2 PRIOR ART
FIG. 2 is a developed perspective view showing a plasma display discharge tube using a conventional trigger scheme.

An embodiment of a method of driving the plasma display discharge tube described with reference to FIGS. 4 and 5 will be described below with reference to FIG. 6. By the way, the drive method according to this embodiment can also be embodied for a trigger type plasma display discharge tube which does not have the memory function described in FIG. 2 as a prior art, thereby making it possible to perform a memory operation.

Figures 6A, 6B, 6C, 6D, 6E, 6F, 6G:
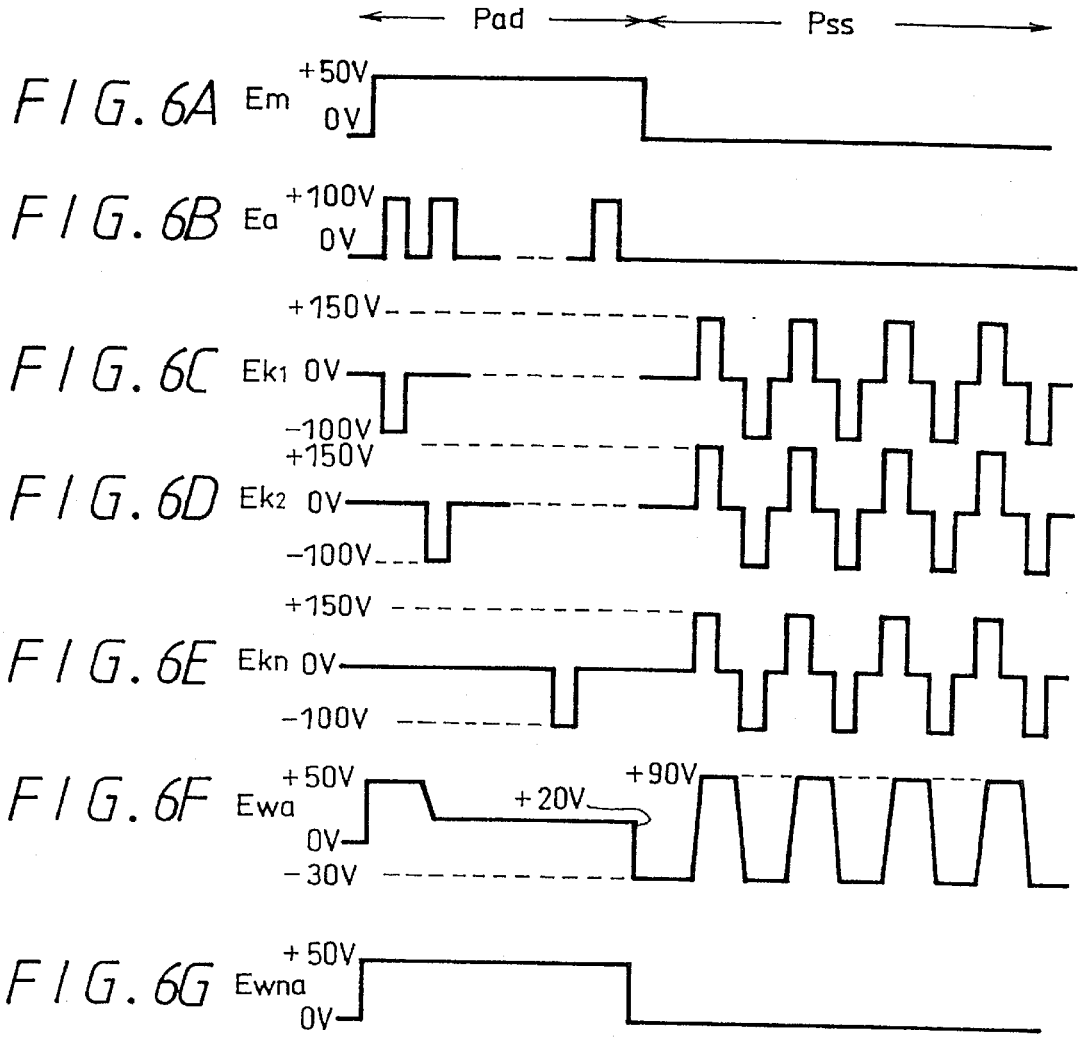
FIGS. 6A to 6G are timing charts showing potentials at respective portions of the display discharge tube in an embodiment of a method of driving the plasma display discharge tube shown in FIGS. 4 and 5.
Figures 7A, 7B, 7C, 7D, 7E, 7F, 7G:
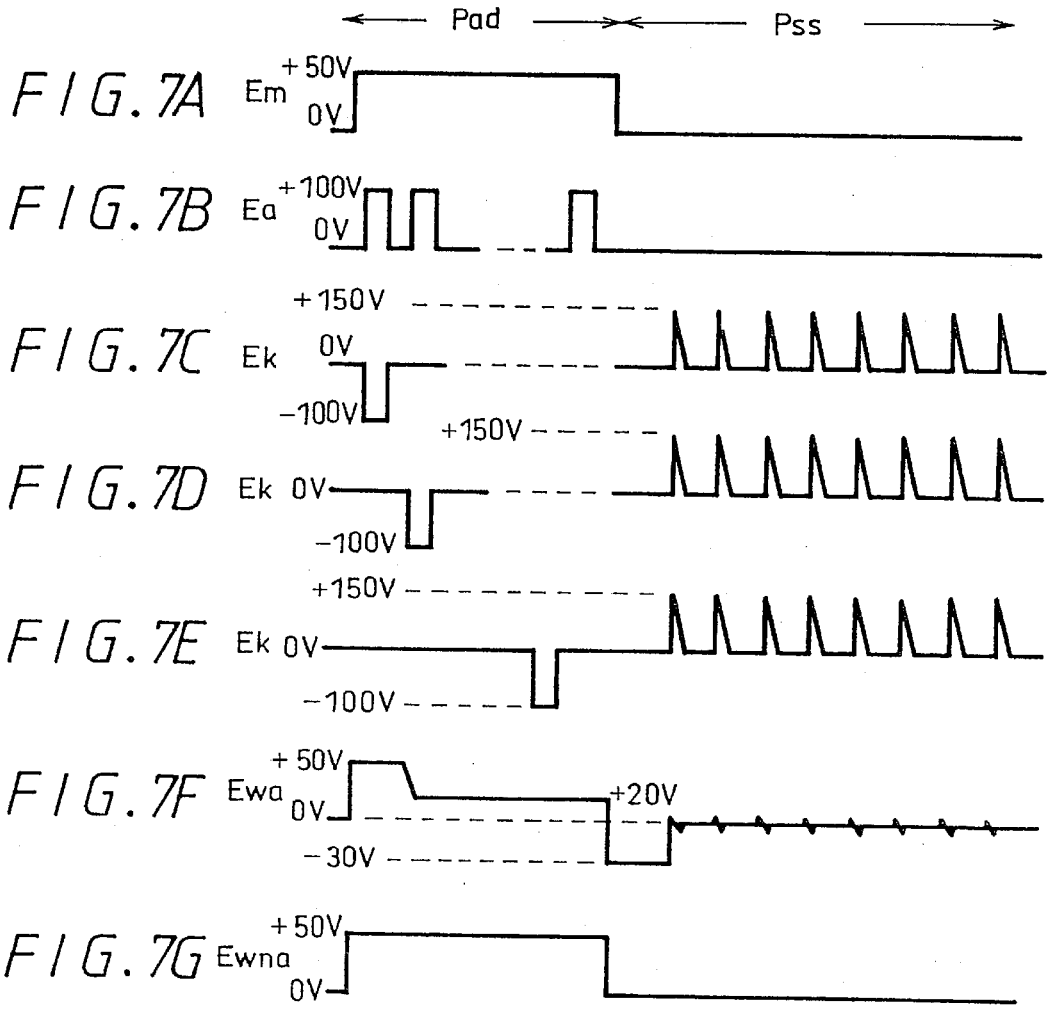
FIGS. 7A to 7G are timing charts showing potentials at respective portions of the display discharge tube in another embodiment of a method of driving the plasma display discharge tube shown in FIGS. 4 and 5.
Figures 8A, 8B, 8C, 8D, 8E, 8F, 8G:
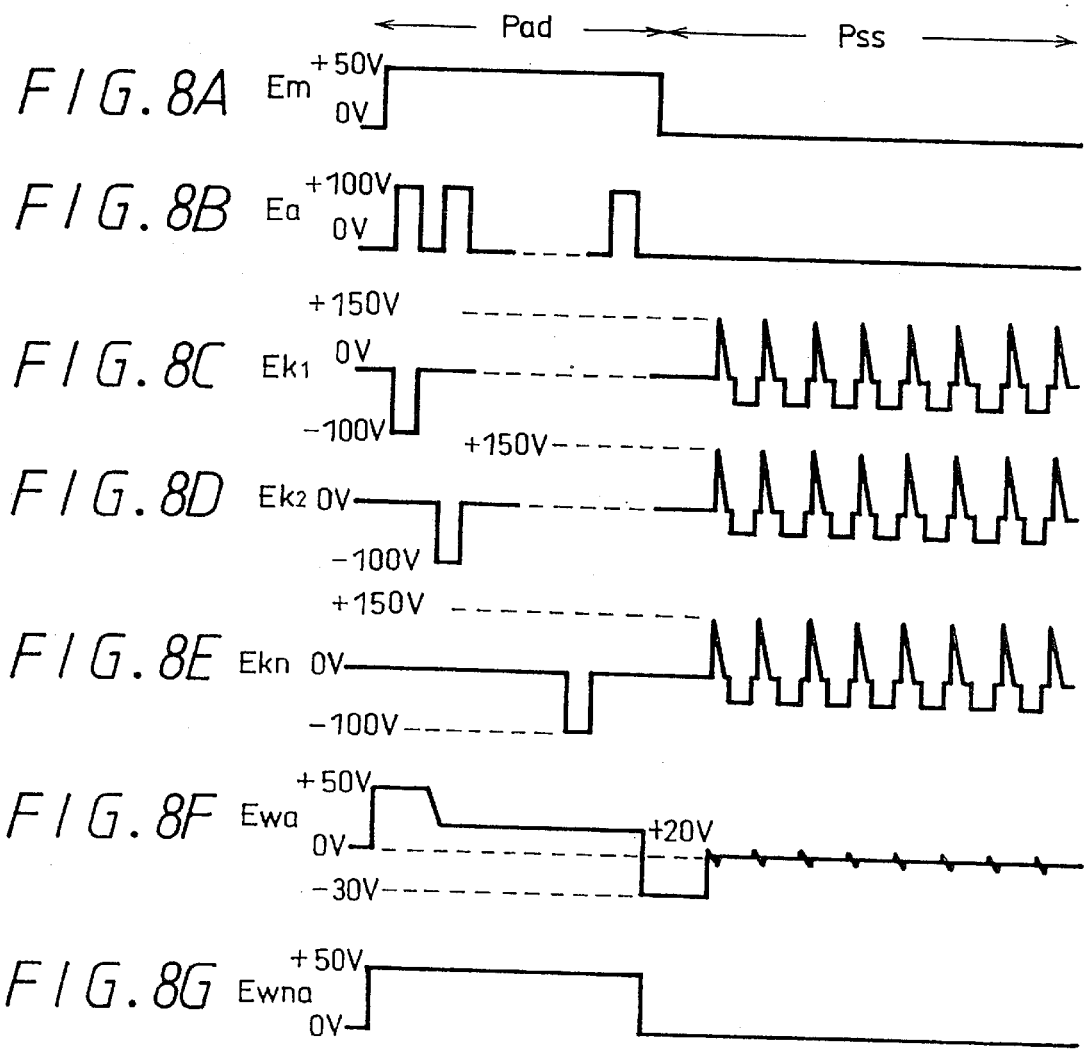
FIGS. 8A to 8G are timing charts showing potentials at respective portions of the display discharge tube in still another embodiment of a method of driving the plasma display discharge tube shown in FIGS. 4 and 5.

FIG. 6A shows a potential Em of the transparent electrode 1 serving as a memory electrode. FIG. 6B shows a potential Ea of the anode electrodes 11 serving as address electrodes. FIGS. 6C to 6F show potentials Ek1, Ek2, . . . , Ekn of the cathode electrodes 9 serving as address electrodes at different timings. FIG. 6F shows a wall potential Ewa of an address cell. FIG. 6G shows a wall potential Ewna of non-addressed cell. Each of the voltages in FIGS. 6A to 6G is an example, and is not limited to the example. In FIGS. 7A to 7G and 8A to 8G to be described later, each of potentials is an example, and is not limited to the example.

In an address period Pad, the potential Em of the transparent electrode 1 and the conductive layer 5 is set to be a high potential (e.g., +50 V) higher than a discharge keep voltage obtained when a discharge occurs between the anode electrodes 11 and the cathode electrodes 9. When an address discharge occurs in a selected crossing portion between the anode electrodes 11 and the cathode electrodes 9 by a so-called linearly sequential drive method, a wall charges having a negative polarity is selectively accumulated on the protective layer 3 on the transparent electrode 1 of a pixel (cell) in which the discharge occurs.

Therefore, when an address discharge for one picture screen is finished, charges having a negative polarity according to an image are accumulated on the entire screen. In this state, when a pulse voltage having a positive polarity is applied to a scanning side electrode, i.e., the cathode electrodes 9 on the Y side electrode, a discharge occurs on only a pixel having the negative wall charge, and the negative wall charges are reversed by the discharge to accumulate positive wall charges. Therefore, when a pulse voltage having a negative polarity is sequentially applied to the plurality of cathode electrodes 9 to make a re-discharge, a positive/negative AC pulse voltage is continuously applied to the cathode electrodes 9 as a sustain pulse voltage (memory pulse voltage), a memory discharge can be kept.

In addition, the following case will be considered. That is, the potential Em changes into 0 V and +50 V, the potential Ea changes into 0 V and 100 V, the potential Ek1 changes into −100 V and 0 V in the address period Pad, and changes into −100 V, 0 v, and +150 V in a sustain period Pss.

The wall potential Ewa of the addressed cell (pixel) is +50 V−30 V=+20 V when a voltage caused by negative accumulated charges is −30 V, for example. In the next sustain period Pss, when the potential Em of the memory electrode 1 is set to be 0 V, the wall potential Ew of the addressed cell is −30 V. For this reason, a difference of 30 V is generated between the addressed cell and a non-addressed cell, i.e., a cell which is not addressed.

In this state, when a pulse voltage of, e.g., +150 V is applied to the cathode electrodes 9 serving as the address electrode, a voltage of +180 V is applied to only the addressed cell. For this reason, a discharge occurs. Since a positive wall charges having a polarity reversed to the polarity described above is generated on the cell in which the discharge occurs, the wall potential Ew of the addressed cell is 90 V, and the wall potential Ew of the cell in which the discharge does not occur is kept 0 V.

Therefore, when the potentials Ek1 to Ekn of the cathode electrodes 9 serving as address electrodes are set to be −100 V, a voltage of 190 V is applied. Only an address makes a re-discharge, and the discharge continues.

Here, a sustain pulse applies a positive/negative pulse voltage (−100 V and +150 V) to only the cathode 9 side serving as the address electrode in the sustain period Pss.

In the above description, assume that a discharge start voltage is set to be 170 V and that a discharge keep voltage is set to be 120 V.

In place of the arrangement in which the cathode electrodes 9 are located on the transparent electrode 1 side, an arrangement in which the anode electrodes 11 are arranged on the transparent electrode 1 side is also possible. In this case, a positive pulse voltage (+150 V) is applied to the anode electrode serving as an address electrode, and a negative pulse voltage (−100 V) is applied to a cathode electrode serving an address electrode.

Referring to FIGS. 6A and 6G, for a simple description, the address period is completely separated from the memory period. However, in an actual drive of a plasma display discharge tube, immediately after pixels on the cathode electrode 9 on one line are addressed, sustain may be started. More specifically, memory discharges of all the pixels are not simultaneously performed, and the memory discharges may be time-serially started at every line. An erasing operation is performed by the same manner as described above.

According to the method of driving a plasma display discharge tube described with reference to FIGS. 6A to 6G, by using a hybrid type plasma display discharge tube having a single AC type electrode which can conventionally perform only a trigger operation serving as an auxiliary role of a DC discharge common to all pixels, a memory operation can be performed by a simple method.

Another embodiment of a method of driving the plasma display discharge tube described with reference to FIGS. 4 and 5 will be described below with reference to FIGS. 7A to 7G. FIGS. 7A to 7G show potentials corresponding to the potentials in FIGS. 6A to 6G. By the way, the drive method of this embodiment can also be embodied for a trigger type plasma display discharge tube which is described as a prior art in FIG. 2 and does not have a memory function, thereby making it possible to perform a memory operation.

In a state wherein negative wall charges exist as explained in connection with in FIGS. 6A to 6G, a sustain pulse having a positive polarity and a small width, e.g., 1 $\mu$sec or less is applied to the cathode 9. In this manner, a discharge occurs in a pixel in which negative wall charges exist, and no discharge occurs in a pixel which is not addressed.

However, unlike the sustain pulse in the case in FIGS. 6A to 6G, the sustain pulse has a small width. For this reason, negative charges are erased by the discharge, but positive charges obtained by reversing the negative charges are not accumulated. This corresponds to a method referred to as a so-called small-width pulse erasing method in a conventional AC type plasma display tube.

Although wall charges are erased as described above, the discharge space is filled with charged particles or metastable atoms by the previous discharge or a so-called priming, a state wherein a re-discharge can easily occur is set. In this state, a pulse voltage having a small width is continuously applied similarly, since no discharge is generated in a pixel which does not have wall charges at the beginning, continuous memory discharges can be carried out in only pixels which are addressed.

More specifically, when a conventional pulse memory operation for applying continuous pulses having the same polarity is to be performed for an AC electrode, this memory operation cannot be performed because of accumulation of wall charges.

However, according to the drive method described with reference to FIGS. 7A to 7G, even an AC electrode can perform the pulse memory operation without forming wall charges.

As in the description with reference to FIGS. 6A to 6G, address and memory operations can also be time-serially performed at every line.

In a plasma display discharge tube, having a DC type Y electrode and the single AC type electrode common to all pixels, which described with reference to FIGS. 7A to 7G, although, for example, the AC type X electrodes and DC type Y electrodes and DC type X electrodes are a plurality of stripe-like electrodes arranged in parallel, these electrodes are commonly connected. For this reason, the present invention can be substantially applied to a so-called three-electrode discharge type AC plasma display discharge tube having a single AC type memory, as a matter of course.

According to the method of driving the plasma display discharge tube described with reference to FIGS. 7A to 7G, a pulse memory scheme which has been conventionally used in only a DC type plasma display discharge tube can also be applied to the electrode of an AC type plasma display discharge tube which can actually achieve long life as a discharge electrode.

Compared with the drive method described with reference to FIGS. 6A to 6G, in case of the drive method described with reference to FIGS. 7A to 7G, since the polarity of the DC electrode side is always set to be positive, the electrode side does not receive the ion impact, and the life time of the panel can be elongated.

In place of the arrangement in which the cathode electrodes 9 are located on the transparent electrode 1 side, an arrangement in which the anode electrodes 11 are located on the transparent electrode 1 side is also possible. A sustain pulse having a small width may be applied to the anode electrodes 11.

Another embodiment of a method of driving the plasma display discharge tube described with reference to FIGS. 4 and 5 will be described below with reference to FIGS. 8A to 8G showing the relationship between pulses applied to a panel. The potentials in FIGS. 8A to 8G correspond to the potentials in FIGS. 6A to 6G, respectively. By the way, the drive method of this embodiment can also be embodied for a trigger type plasma display discharge tube which is described as a prior art in FIG. 2 and does not have a memory function, thereby making it possible to perform a memory operation.

This method of driving the plasma display discharge tube is improved in consideration of the following point. That is, in the drive method described with reference to FIGS. 7A to 7G, some wall charges are undesirably generated due to discharge delay of each cell and variations in characteristic though a pulse having a small width is used.

In order to erase the positive wall charges to reliably perform a pulse memory operation, after a sustain pulse having a positive polarity and a small width is applied to the DC electrode, a pulse having a low voltage and a negative polarity is applied to the same electrode. The voltage applied in this case is not a voltage which makes a re-discharge between the DC electrode and an AC electrode, and the pulse width may be large than that of the discharge keep pulse. In this manner, the positive wall charges on the AC electrode can be erased by using spatial charges remaining in a discharge space immediately after a discharge caused by a positive sustain pulse having a small width.

According to the method of driving the plasma display discharge tube described with reference to FIGS. 8A to 8G, compared with the drive method which is described with reference to FIGS. 7A to 7G and has a memory function without forming wall charges, a drive operation can be made reliable.

Figure 9:
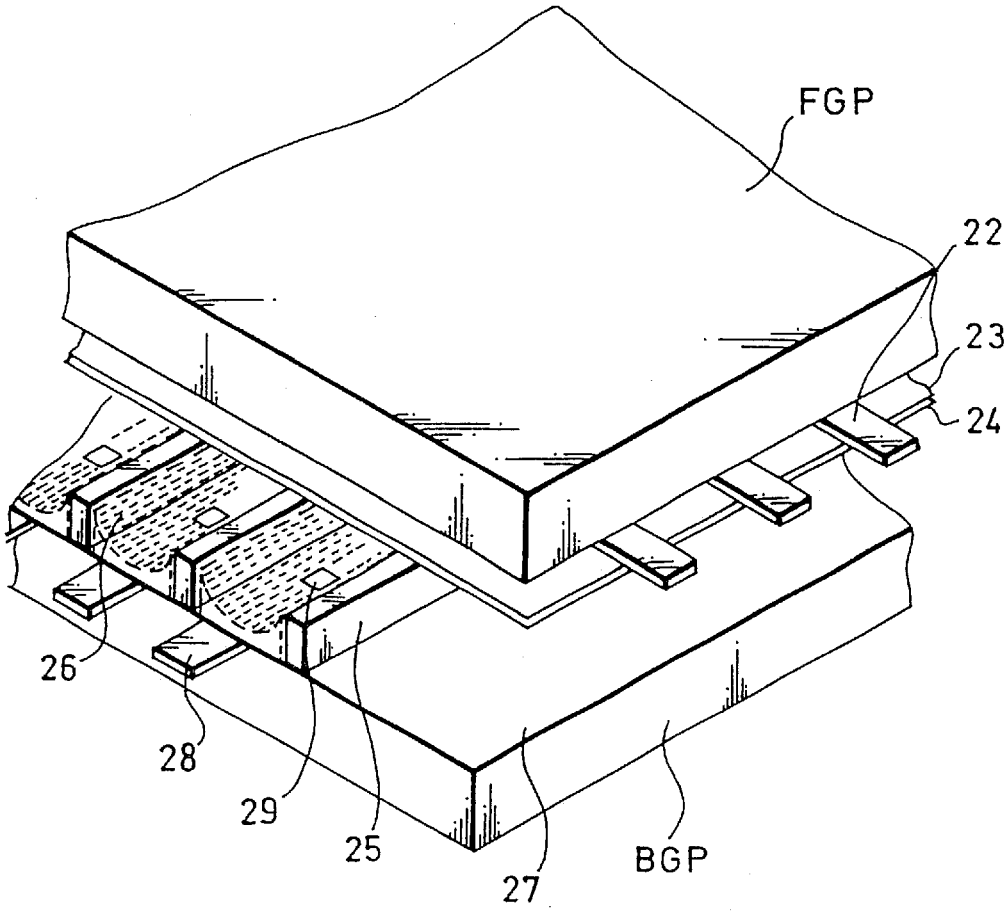
FIG. 9 is a developed perspective view showing a plasma display discharge tube according to another embodiment of the present invention.
Figure 10:
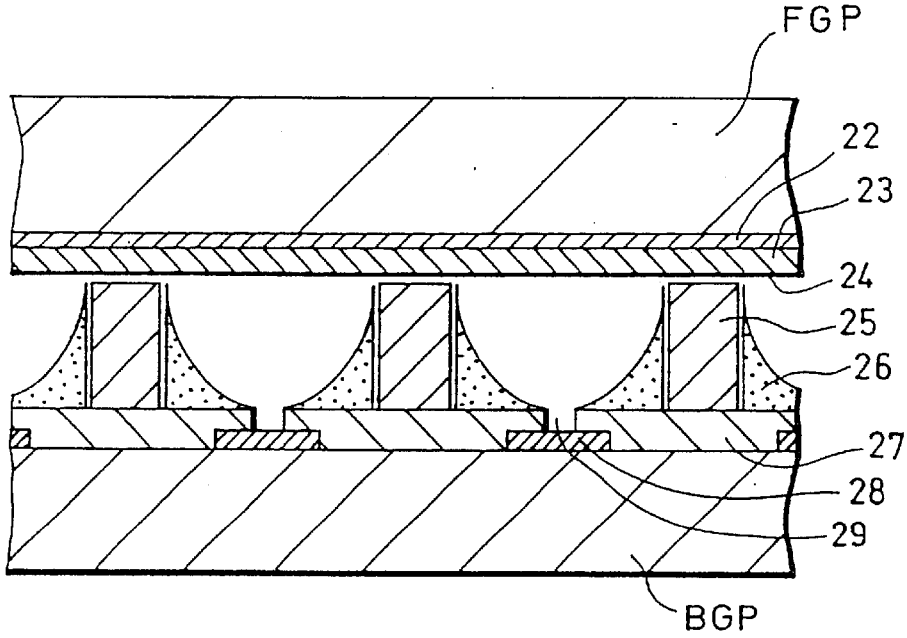
FIG. 10 is a sectional view showing the plasma display discharge tube shown in FIG. 9.

A plasma display discharge tube according to an embodiment of the present invention will be described below with reference to the developed perspective view in FIG. 9 and the sectional view in FIG. 10. Referring to FIGS. 9 and 10, reference symbol FGP denotes a front glass plate, and reference symbol BGP denotes a back glass plate. Respective elements constituting a plasma display discharge tube are arranged between these glass plates FGP and BGP.

On the front glass plate FGP, a plurality of stripe-like transparent Y electrodes (cathode electrodes) 22 having the same width and extending in the lateral direction of a picture screen are adhesively formed at a predetermined interval. The plurality of Y electrodes 22 are made of a material such as indium oxide, tin oxide or the like. However, since these materials have a high resistance, when a material having a low resistance is required, a low-resistance material such as chromium, copper or the like is adhesively formed on the plurality of Y electrodes 22 made of indium oxide, tin oxide, or the like to be overlapped thereon.

An insulating layer 23 is adhesively formed on the front glass plate FGP by printing of a low-melting-point glass paste and sintering or the like performed thereafter to cover the Y electrodes 22. A protective layer 24 is adhesively formed on the insulating layer 23 by vapor deposition of MgO or the like.

On the back glass plate BGP, a plurality of stripe-like X electrodes (anode electrodes) 28 having the same width and extending in the longitudinal direction of the picture screen are adhesively formed at a predetermined interval by printing of a nickel paste and sintering performed thereafter.

On the front glass plate FGP, an insulating layer 27 is adhesively formed by printing of a low-melting-point glass and sintering performed thereafter to cover the plurality of X electrodes 28.

Small holes 29 constituting cells respectively are formed through the insulating layer 27 at positions where the X electrodes 28 cross the Y electrodes 22. The small holes 29 are formed simultaneously with the printing of the insulating layer 27.

Rod-like partition walls (barrier ribs) 25 each having a rectangular section are formed on the insulating layer 27 by laminate printing of a low-melting-point glass to be located between the plurality of X electrodes 28, respectively.

A phosphors 26 is adhesively formed on the surfaces of the insulating layer 27 and the plurality of partition walls 25 except for the inner surfaces of the plurality of small holes 29. The phosphor 26 is formed such that red, green, and blue phosphor are sequentially and circularly coated on every X electrode 28, respectively, thereby constituting a color plasma display discharge tube.

As described above, the periphery of each of the front glass plate FGP and the back glass plate BGP on which the respective elements constituting the plasma display discharge tube are arranged is sealed by a glass frit or the like, and discharge gases such as helium, xenon, neon, argon and the like are properly mixed to each other and sealed into the tube.

According to the plasma display discharge tube described with reference to FIGS. 9 and 10, the electrode structure can be simplified to reduce manufacturing steps in number, driving using a pulse memory scheme which can be conventionally realized by only a DC type plasma display discharge tube having high emission efficiency and excellent responsibility is made possible, so that a plasma display discharge tube having a long-life AC type electrode can be obtained.

In addition, according to the plasma display discharge tube described with reference to FIGS. 9 and 10, although the plasma display discharge tube is a 2-electrode type plasma display discharge tube having a half-AC structure, the anode electrodes are separated from the cathode electrodes. For this reason, when the cathode electrodes are used as an AC electrode, degradation caused by the ion impact upon a display discharge can be prevented. As a matter of course, in an address period and an address set period, the X electrodes may receive ion impact. However, this ion impact is smaller than impact upon the display discharge so that the ion impact can be neglected.

Figure 3:
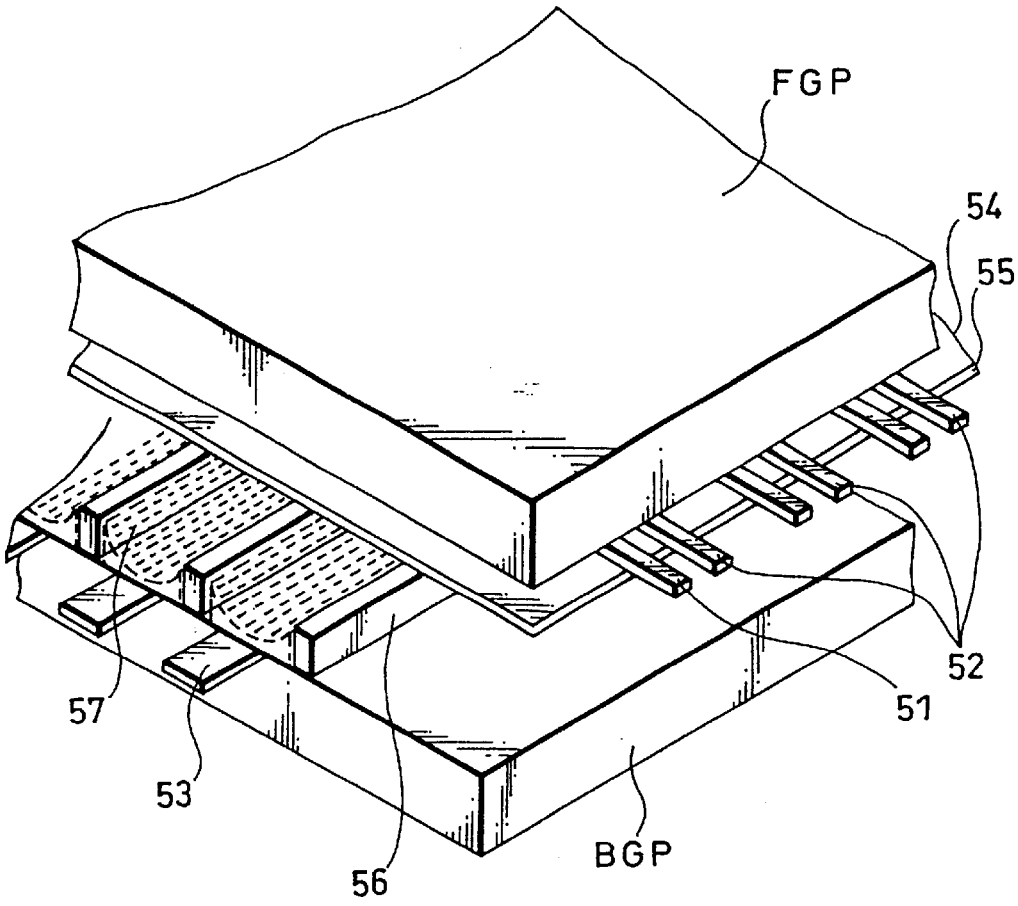
FIG. 3 PRIOR ART
FIG. 3 is a developed perspective view showing a three-electrode AC type plasma display discharge tube.

According to the plasma display discharge tube described with reference to FIGS. 9 and 10, as is apparent from comparison between a color plasma display discharge tube and the conventional 3-electrode type AC plasma display tube in FIG. 3, the number of stripe-like Y electrodes 22 may be made half, and this plasma display discharge tube has advantages in view of manufacturing and performance such as luminance or the like.

Figures 11A, 11B, 11C, 11D, 11E:
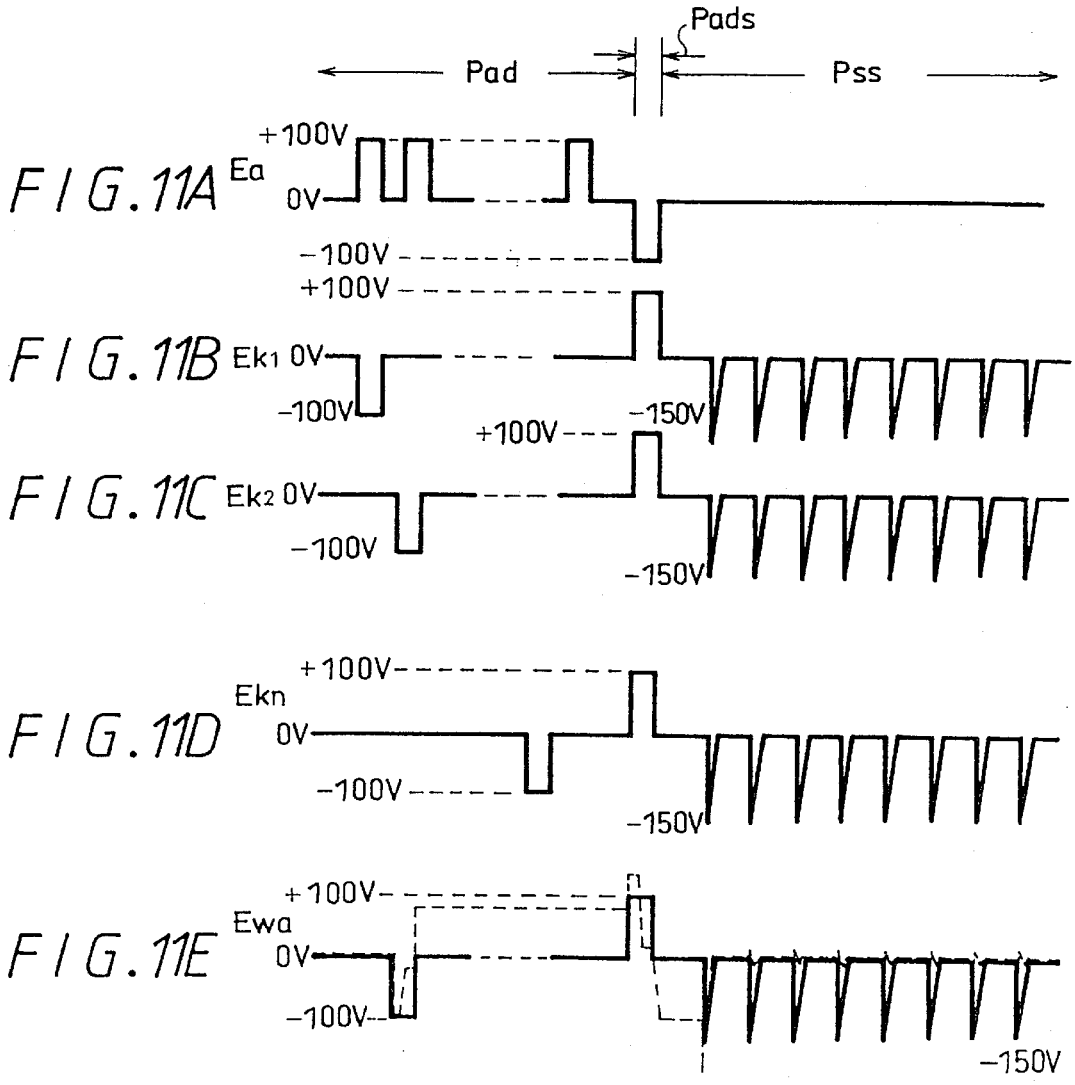

An embodiment of a method of driving the plasma display discharge tube described with reference to FIGS. 9 and 10 will be described below with reference to FIGS. 11A to 11G. FIG. 11A shows a potential Em of the transparent electrode 1 serving as a memory electrode. FIG. 11B shows a potential Ea of the anode electrodes 11 serving as address electrodes. FIGS. 11C to 11F show potentials Ek1, Ek2, . . . , Ekn of the cathode electrodes 9 serving as address electrodes at different timings. FIG. 11F shows a wall potential Ewa of an address cell. FIG. 11G shows a wall potential Ewna of a non-addressed cell. Each of the respective voltages in FIGS. 11A to 11G is an example, and is not limited to the example.

In an address period Pad, an operation of accumulating negative charges on the Y electrodes 22 of the cells (small holes) 29 to be turned on is performed according to an image information before a sustain period Pss is entered. Although there are several methods of performing the operation, the relationship among pulses in the address period Pad in FIGS. 11A to 11E is one of the examples. In this certain case, a pulse voltage having a positive polarity according to a signal is applied to the plurality of X electrodes 28, and a pulse voltage having a negative polarity is sequentially applied as a scanning pulse to the plurality of Y electrodes 22. When linearly sequential addressing operation for one picture screen is finished in this manner, in an addressed cell, i.e., a cell in which an address discharge occurs, positive charges are accumulated on the Y electrodes 22 as distributed wall charges in accordance with an image.

In the subsequential address set period Pads, when such a pulse voltage which makes the polarity of all the X electrodes 28 negative and the polarity of all the Y electrodes 22 positive is applied, a voltage is superposed on the cell selected by the above address discharge, i.e., the cell having positive wall charges to generate a high voltage, thereby making a discharge therein. With the discharge in the address period Pad, the positive wall charges in the addressed cell are reversed to form a state wherein negative wall charges are distributed. A change in the potential of the cell on the insulating layer 27 caused by the wall charges in this period is indicated by a dotted line on the waveform graph in FIG. 11E.

If there is no problem on a circuit arrangement, as the polarities of the address pulse, the polarities of the X electrode 28 side and the Y electrode 22 side can be set to be negative and positive, respectively, as a matter of course. In that case, the address set period is not necessary.

In the sustain period Pss following the address period Psd or the address set period Pads, when a sustain pulse voltage having a negative polarity is applied to the Y electrodes 22 in a state wherein negative wall charges according to the image are distributed as described above, a discharge occurs in only the cells which have negative charges since a voltage is superposed. When the discharge occurs, the negative wall charges which are electrified are immediately erased, and the polarity of the charges are reversed to begin to electrify positive charges.

However, when the width of the sustain pulse is decreased as about 1 $\mu$sec, the discharge is stopped without charging positive wall charges. This is a method called a small-width pulse erasing method in an AC type plasma display discharge tube.

As described above, the wall charges are erased by the first sustain discharge occurring in an addressed cell, the same state as in a non-addressed cell being set. However, a priming, i.e., charged particles and metastable atoms exist in the discharge space of the cell in which the sustain discharge occurs, a discharge in this cell occurs easier than a cell in which no discharge occurs, and the cell makes a re-discharge at a low voltage. Therefore, when a sustain pulse voltage having a negative polarity is continuously applied, a discharge continues in only an addressed cell. More specifically, a pulse memory operation can be performed by even an AC electrode.

In the pulse timing charts in FIGS. 11A and 11G, although the address period Pad is completely separated from the sustain period Pss, the following arrangement is possible. That is, a sustain pulse voltage is applied immediately after the selection of the Y electrodes 22, a sustain discharge can also be time-serially started. An erasing operation is also performed by the same manner as described above.

According to the method of driving a plasma display discharge tube described with reference to FIGS. 11A to 11G, a pulse memory operation can be performed by even an AC type cathode, and an electrode material which can achieve life longer than that of a DC type cathode, i.e., an Mgo film also used as the protective layer 24 can be applied.

What is claimed is:

1. In a method of driving a plasma display discharge tube, which causes a plasma display discharge tube having a DC type address electrode constituted by an X-Y matrix electrode and an AC type memory electrode arranged opposite to said DC type address electrode and common to all pixels to perform a memory discharge display, the method of driving the plasma display discharge tube being characterized in that, in an address operation period by said DC type address electrode, after a distribution of wall charges having a positive or negative polarity according to an image is formed on an insulating layer of said AC type memory electrode, an AC sustain pulse voltage which becomes alternately positive or negative with respect to a potential of said AC type memory electrode is applied to a Y electrode serving as a scanning electrode of said DC type electrode in a memory display period, thereby performing a continuous memory discharge display on the basis of wall charges formed on the insulating layer of said AC type address electrode in said address operation period.

2. A method of driving a plasma display discharge tube, which causes a plasma display discharge tube having a DC type address electrode constituted by an X-Y matrix electrode and an AC type memory electrode arranged opposite to said DC type address electrode and common to all pixels to perform a memory discharge display, the method of driving display discharge tube being characterized in that after wall charges having a negative polarity according to an image are formed on an insulating layer of said AC type memory electrode by an address operation performed by said DC type address electrode, in a memory operation period, a sustain pulse voltage which becomes positive with respect to a potential of said AC type memory electrode and has a small width not to form wall charges having a positive polarity generated by a sustain discharge on said AC type memory electrode intermittently and continuously applied to one of X and Y electrodes constituting said DC type address electrode in a pulse period in which a priming effect which lowers a re-discharge voltage in a space in which a discharge has occurred once is not eliminated, and a continuous memory discharge display is performed between said DC type address electrode and said AC type memory electrode.

3. In a method of driving a plasma display discharge tube according to claim 2, the method of driving a plasma display discharge tube being characterized in that a pulse voltage having a negative polarity, which does not make a discharge but can erase wall charges having a positive polarity and formed undesirably on said AC type memory electrode is applied between adjacent pulses of said continuous sustain pulse voltage having a positive polarity and a small width, to one of X and Y electrodes constituting the DC type address electrode in said memory operation period.

* * * * *